313-414 SR
4/5/88 OR 4,736,133

United States Patent [19]
Barbin et al.

[11] Patent Number: 4,736,133
[45] Date of Patent: Apr. 5, 1988

[54] INLINE ELECTRON GUN FOR HIGH RESOLUTION DISPLAY TUBE HAVING IMPROVED SCREEN GRID PLATE PORTION

[75] Inventors: Robert L. Barbin, Manheim Township, Lancaster County; Hsing-Yao Chen, West Hempfield Township, Lancaster County; Loren L. Maninger, East Hempfield Township, Lancaster County, all of Pa.

[73] Assignee: RCA Corporation, Princeton, N.J.

[21] Appl. No.: 39,815

[22] Filed: Apr. 15, 1987

Related U.S. Application Data

[63] Continuation-in-part of Ser. No. 855,486, Apr. 24, 1986, abandoned.

[51] Int. Cl.[4] ..... H01J 29/50; H01J 29/56
[52] U.S. Cl. ..... 313/414; 313/449
[58] Field of Search ..... 313/412, 413, 414, 447, 313/448, 449

[56] References Cited

U.S. PATENT DOCUMENTS 4,234,814 11/1980 Chen et al. ..... 313/412
4,319,163 3/1982 Chen ..... 315/14
4,473,775 9/1984 Hosokoshi et al. ..... 315/14
4,514,659 4/1985 Chen ..... 313/412
4,523,123 6/1985 Chen ..... 313/412

FOREIGN PATENT DOCUMENTS 56-167241 12/1981 Japan ..... 313/414

*Primary Examiner*—David K. Moore
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

An electron gun for a high resolution color display tube comprises three inline cathode assemblies, a control grid with three inline apertures, a screen grid with three inline apertures, a screen grid slot plate with three inline substantially rectangular slots each associated with a different one of the apertures in the screen grid, and a main electron lens. The screen grid slot plate is attached to the screen grid on the side thereof facing the main electron lens. Each of the cathode assemblies produces an electron beam having a given beam current. Each of the slots in the screen grid slot plate has an inline dimension and a transverse dimension which are selected for the given beam current to independently control the horizontal and vertical sizes of the spot produced by each of the electron beams at a distance from the electron gun.

19 Claims, 3 Drawing Sheets

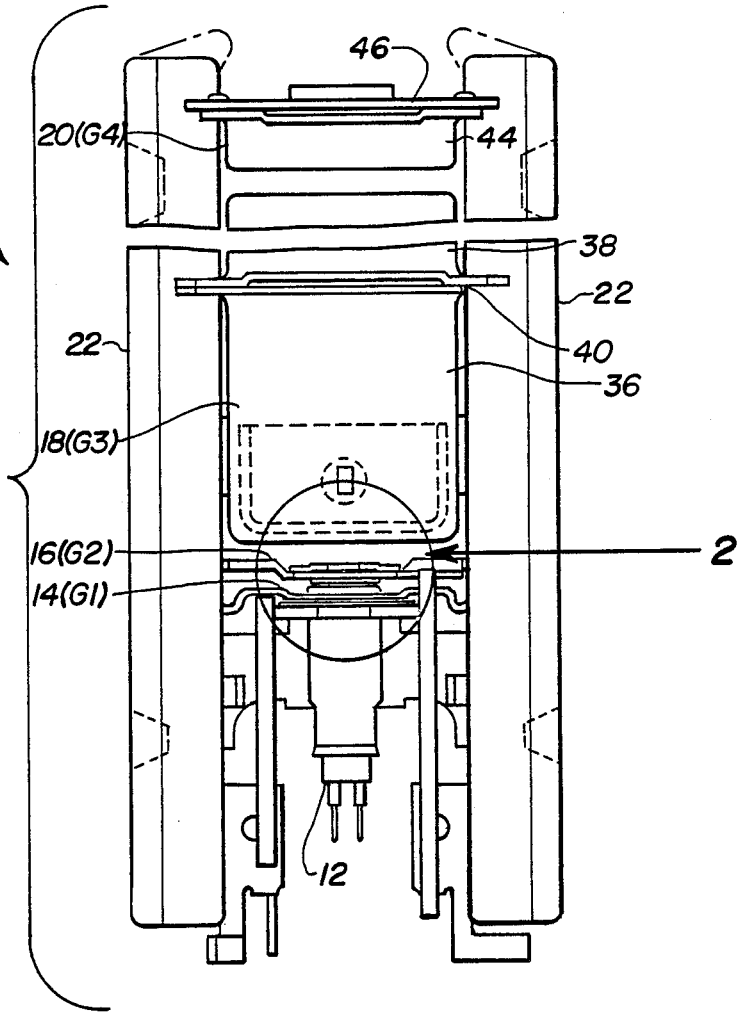
Fig. 1
Fig. 2
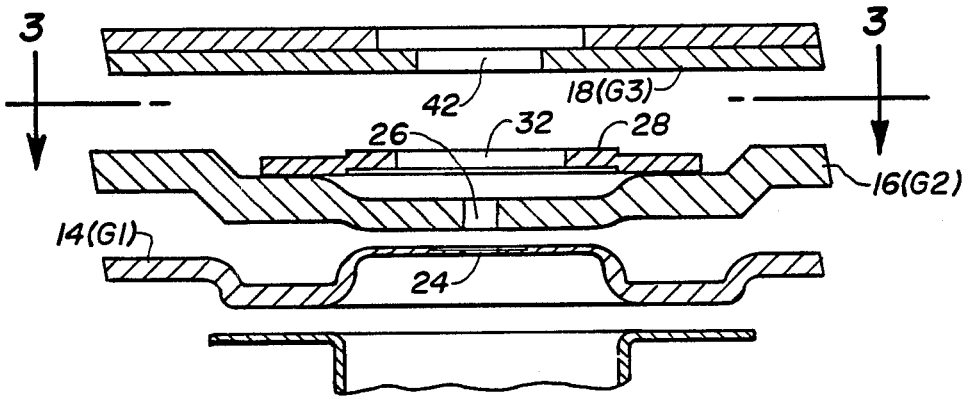

INLINE ELECTRON GUN FOR HIGH RESOLUTION DISPLAY TUBE HAVING IMPROVED SCREEN GRID PLATE PORTION

This is a continuation-in-part of application Ser. No. 855,486, filed Apr. 24, 1986, now abandoned.

BACKGROUND OF THE INVENTION

This invention relates to electron guns for use in cathode ray tubes, and particularly to an improved inline electron gun for use in high resolution color display tubes.

BACKGROUND OF THE INVENTION

Over the past several years, the cathode-ray tube has evolved as an important means for displaying information in computer terminals. This is because the cathode ray tube is a well developed, cost effective device with fast writing and erasing speeds. Previously, most display tubes have been of the monochrome type; however, recent needs have been for high resolution color displays, to properly present the increasingly sophisticated and complex information generated by computers. Many of the commercially sold high resolution color display tubes have used delta electron gun and dot screen systems. When properly set up, such tubes have very good center and corner resolutions and good electron beam convergence. However, it is known that the conventional circuitry required for a delta electron gun is not only costly, but also subject to drifts. Since display tubes are usually viewed at close range, such convergence drifts are very undesirable.

It has been determined that a self-converged system using an inline electron gun, such as that disclosed in U.S. Pat. No. 3,772,554, issued to R. H. Hughes on Nov. 13, 1973; a self-converging yoke; and a dot screen provides improved display tube performance because of the elimination of convergence drift. However, the performance of the electron beam spot at the corners of the display tube tends to suffer, because of the self-converging yoke. Since the corners are just as important as the center of the tube when displaying characters thereon, there is need to improve display tubes and especially the inline electron guns therefor, to improve performance at the corners of the tubes.

Such an improved inline electron gun is described in U.S. Pat. No. 4,514,659, issued to H-Y. Chen on Apr. 30, 1985. That electron gun includes a conventional control grid and a screen grid which includes three rectangular slots located at the apertures on the side of the screen grid facing away from the control grid. The slots extend lengthwise, in the inline direction of the inline apertures, and have a ratio of the depth of the slots to their widths in the range of 0.13 to 0.23. The length of the slot is such that it appears to be infinitely long, optically, and does not affect the electron beams in at least one dimension. Each of the slots is substantially equal in size to the other slots, and each is substantially tangent to the beam-forming aperture associated therewith. The inline electron gun described in the Chen patent was designed to obtain optimum tube performance at a peak electron beam current of approximately 200 microamperes (uA).

The display screen of a high resolution color display tube comprises a mosaic of blue-, green-, and red-emitting phosphor elements grouped in triads of the different emitting colors. A shadow mask having a multiplicity of apertures therethrough is spaced from the display screen. Each aperture in the shadow mask is associated with one of the triads on the screen. In such display tubes, there are often regular pixel patterns displayed on the display screen. A pixel is an electronically generated burst of an electron beam which excites a portion of the display screen. It is desirable to keep the pixel small for high resolution. However, these pixel patterns can visually interact with the aperture structure in the shadow mask to generate moire patterns and graininess in the characters and graphics produced on the display screen. The intensity of the interaction is related to the size and spacing of the shadow mask apertures and the size and spacing of the pixels. The former generally cannot be reduced because of practical limitations on: the manufacturing of the shadow mask and the phosphor screen, the light output of the screen, and the register tolerance between the shadow mask and the screen. Consequently, it has been found that the minimum spot size of the individual electron beams must be made sufficiently large in order to minimize the intensity of the interaction. However, the spot size cannot be made too large, or resolution would be adversely affected.

The aperture structure of the shadow mask and the pixel patterns differ in the horizontal and vertical directions. Also, the focusing effects of the self-converging yoke of the display tube are different in the horizontal and vertical directions. The scan distance the electron beam travels during the on-time of each pixel also increases the effect of the spot size in the horizontal direction. As a result, the minimum spot size that can be produced without creating moire patterns or graininess in the characters on the display screen is different in the horizontal and vertical directions. Thus, it is necessary to provide a means for independently controlling both the horizontal and the vertical dimensions of each of the electron beam spots generated by the electron gun.

SUMMARY OF THE INVENTION

An electron gun for a high resolution color cathode-ray tube comprises a plurality of inline cathode assemblies, a control grid with a plurality of inline apertures, a screen grid with a plurality of inline apertures, a screen grid plate portion with a plurality of inline openings each associated with a different one of the apertures in the screen grid, and a main electron lens. The screen grid plate portion is disposed on the side of the screen grid facing the main electron lens. Each of the cathode assemblies produces an electron beam. Each of the openings in the screen grid plate portion has an inline dimension and a transverse dimension which are selected to independently control the horizontal and vertical sizes of the spot produced by each of the electron beams at a distance from the electron gun, so as to maximize resolution and to minimize moire patterns and character graininess.

BRIEF DESCRIPTION OF THE DRAWINGS

FIG. 1 is a longitudinal view of an inline electron gun embodying the present invention.

FIG. 2 is an enlarged sectional view of the area within the circle 2 of FIG. 1.

DETAILED DESCRIPTION OF THE PREFERRED EMBODIMENTS

Figure 3:
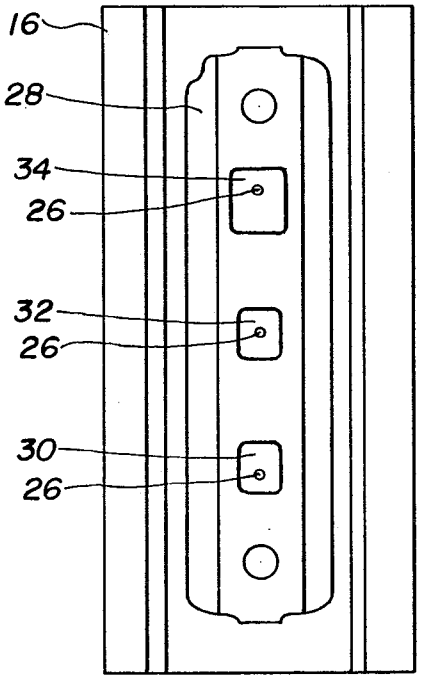
FIG. 3 is a plan view taken along line 3—3 of FIG. 2.

FIG. 1 illustrates an electron gun 10 comprising three inline cathode assemblies 12 (only one of which is shown), a control grid (G1) 14, a screen grid (G2) 16, and a main electron lens including a first focusing electrode (G3) 18 and a second focusing electrode (G4) 20, all mounted in spaced relationship on a pair of insulator support rods 22. The three inline cathode assemblies 12 produce three inline electron beams (not shown). The control grid 14 is adjacent to the cathode assemblies and has three inline apertures 24 (only one of which is shown in FIG. 2) aligned with the cathode assemblies 12. For convenience and to avoid cluttering the drawing, the cathode assemblies, which are conventional, are not shown in FIG. 2. The screen grid 16 is located adjacent to and spaced from the control grid 14. The screen grid 16 is formed to provide three structural levels or longitudinally spaced, parallel planes. The lowest level of the top side of the screen grid 16 includes three inline apertures 26 which lie in the first plane and which are aligned with the three apertures 24 of the control grid 14. A screen grid plate portion 28, shown in FIGS. 1, 2 and 3, is attached to the intermediate level, or the second plane on the upper surface of the screen grid 16. The screen grid plate portion 28 has three inline openings therethrough which preferably comprise substantially rectangular slots 30, 32 and 34. While rectangular slots are preferred, any elongated opening may be used. Slots 30, 32 and 34 may be identical in size, or the sizes may be unequal as described below. Since the screen grid plate portion 28 is attached to the intermediate level of the screen grid 16, the slots 30, 32 and 34 lie in the second plane and are longitudinally spaced from the apertures 26 which lie in the first plane of the screen grid 16, creating the effect of a thick slot formed in the relatively thin material of the screen grid. The first focusing electrode 18, as shown in FIG. 1, comprises a pair of cup-shaped members 36 and 38 joined together at their open ends 40. The cup-shaped member 36 includes three inline apertures 42, only one of which is shown in FIG. 2, formed in the bottom and through which electron beams enter the first focusing electrode 18. The apertures 42 are aligned with the inline apertures 26 in the screen grid 16. The cup-shaped member 38 includes three large inline apertures (not shown) through which the electron beams exit from the first focusing electrode 18. The second focusing electrode 20 includes a cup-shaped lower member 44 and a plate member 46 each of which has large apertures (not shown) therethrough. The apertures in the main lens of the electron gun 10 have a constant beam-to-beam spacing and are aligned with the screen grid apertures 26.

One preferred embodiment of the electron gun 10 is particularly optimized when the approximate dimensional constraints presented in the TABLE I are met. In this preferred embodiment, two of the cathode assemblies 12 produce electron beams having a peak electron beam current of approximately 200 uA, and the other cathode assembly 12 produces an electron beam having a peak electron beam current of approximately 380 uA. The latter electron beam impinges on the red-emitting phosphor screen elements (not shown) on the display screen. The difference in electron beam currents is required because of different phosphor efficiencies and color temperatures of the particular phosphor materials. In the preferred embodiment presented in the TABLE I, the outer slots 30 and 34 are offset so that the inline distance from the center of slot 30 to the center of slot 32 is 4.99 mm and the inline dimension distance from the center of slot 32 to the center of slot 34 is 4.65 mm. The purpose of the offset is discussed below.

TABLE I

| | |
|---|---|
| Diameter of control grid apertures 24 | 0.46 mm |
| Control grid to screen grid spacing | 0.20 mm |
| Diameter of screen grid apertures 26 | 0.46 mm |
| Thickness of the screen grid (at the apertures) | 0.38 mm |
| Center-to-center spacing between adjacent screen grid apertures | 5.08 mm |
| Screen grid plate portion 28 dimensions | |
| slots 30, 32 (inline × transverse) | 2.16 mm × 1.78 mm |
| slot 34 (inline × transverse) | 3.81 mm × 2.54 mm |
| thickness at slots | 0.25 mm |
| Longitudinal spacing from top of screen grid plate portion 28 to the top of the lowest level of the screen grid (at the apertures 26) | 0.56 mm |

GENERAL CONSIDERATIONS

It is known that a lower electron beam current is required for color display tubes than for commercial picture tubes. Commercial color picture tubes are generally operated at a peak electron beam current of about 4.0 milliamperes (mA) or higher. Most color display tubes operate at an electron beam current substantially lower than that, typically less than 400 uA. The preferred electron gun described herein is designed to provide optimum tube performance at a peak electron beam current of approximately 200 uA for the cathode assemblies addressing the blue- and the green-emitting phosphor elements, and approximately 380 uA for the cathode assembly addressing the red-emitting phosphor elements of the display tube screen.

The screen grid plate portion 28 described herein differs from prior screen grid slot structures, such as that disclosed in the above-referenced U.S. Pat. No. 4,514,659, in that the former plate portion 28 not only improves the shape of the electron beam spot on the display screen but also substantially prevents visual abnormalities such as moire patterns and character graininess.

In the present electron gun 10, two of the cathode assemblies 12 operate at a peak electron beam current of 200 uA, and the third cathode assembly operates at a peak electron beam current of 380 uA. The sizes and shapes of the slots 30, 32 and 34 in the screen grid plate portion 28, in conjunction with the longitudinal spacing between the plate portion 28 and the screen grid 16, the thickness of the screen grid 16 and the diameter of the screen grid apertures 26, are among the factors which control the sizes and shapes of the electron beams exiting from the screen grid. By properly selecting the inline and transverse dimensions of each of the slots 30, 32 and 34 and the longitudinal spacing between the top of the plate portion 28 and the lowest level of the screen grid 16, the convergence angle of each individual electron beam can be controlled in the horizontal and vertical directions. This, in turn, controls the horizontal and vertical spot size on the display screen relatively independently for each electron beam. The longitudinal spacing from the top of the plate portion 28 to the lowest level of the top of the screen grid 18 is believed to be effective in reducing aberrations in the electron beams. The slots 30, 32 and 34 which are longitudinally spaced from the screen grids apertures 26 in the plate portion 28 affect the field more strongly in the screen grid apertures 26 than comparable size slots formed in the surface of the screen grid 18 or a flat slot plate attached directly to a flat surface of a screen grid electrode, and allow larger and more manufacturable slots to be used.

In the present example, the largest slot 34 is associated with the electron beam having a peak electron beam current of 380 uA. The scren grid aperture 26 has a diameter of 0.46 mm, and the slot 34 associated therewith has an inline dimension of 3.81 mm and a transverse dimension of 2.54 mm. Thus, the inline or horizontal axis of the slot 34 is about 8.33 times the diameter of the aperture 26, and the transverse or vertical axis of the slot 34 is about 5.56 times the diameter of the aperture 26. The slot 34 provides the small amount of horizontal and vertical focusing desired for the higher current electron beam. The convergence angle of the higher current electron beam is such that relatively large electron beam size is provided in the main electron lens. The large beam size is demagnified therein to provide an optimum size electron beam spot at a distance remote from the electron gun 10.

Conversely, the smaller slots 30 and 32, which are associated with the electron beams having a peak electron beam current of 200 uA, have an inline (horizontal) dimension of 2.16 mm and a transverse (vertical) dimension of 1.78 mm. The screen grid apertures 26 associated with the slots 30 and 32 each have a diameter of 0.46 mm. Thus, the horizontal axis of slot 30 and 32 is about 4.72 times the diameter of the apertures 26, and the vertical axis is about 3.89 times the diameter of apertures 26. The smaller slots 30 and 32 in the plate portion 28, in conjunction with the screen grid electrode 16, provide stronger focusing, similar to the effect of a thicker screen grid. The lower current electron beams exiting from slots 30, 32 are more strongly focused horizontally and vertically than the higher current electron beam exiting from slot 34, to provide a convergence angle that produces a smaller electron beam spot in the main electron lens and a larger electron beam spot at a distance remote from the electron gun 10.

The dimensions disclosed for the slots 30, 32 and 34 are selected to independently control the electron beam spot sizes and to equalize the spot sizes at the shadow mask for the different electron beam currents, so as to maximize resolution while minimizing moire patterns and character graininess.

In the preferred embodiment described herein and shown in FIG. 3, the outer slots 30 and 34 are offset or asymmetric with respect to the outer screen grid apertures 26, so that each of the outer slots is displaced toward the center slot. In normal operation, the G3 and G4 electrodes converge the outer electron beams and the center beam at the center of the screen. If the G3–G4 voltage ratio is varied, e.g., by changing the G3 focus voltage relative to the G4 ultor voltage, misconvergence of the electron beams occurs. If, for example, the G3 focus voltage is made more positive, the G3–G4 main lens is weakened, and the outer electron beams tend to misconverge outwardly. At the same time, the increase in G3 focus voltage relative to the G2 screen grid voltage strengthens the G2–G3 lens convergence action. The outer slots 30 and 34, located asymmetrically inward of the outer screen grid apertures 26, distort the electrostatic field formed in the vicinity of the outer apertures 26 and tend to converge the outer electron beams toward the center beam. The outer slots 30 and 34 thus compensate for the misconvergence that occurs in the main lens.

Likewise, if the G3 focus voltage is made less positive, the G3–G4 main focus lens is strengthened, and the outer beams tend to converge inwardly. Simultaneously, the decrease in G3 focus voltage relative to the G2 screen grid voltage weakens the G2–G3 lens convergence action. The outer slots 30 and 34 distort the electrostatic field less strongly, so that the outer beams tend to misconverge outwardly from the center electron beam after the outer beams pass through the apertures 26 in the screen grid electrode 16. The net effect is that the asymmetric slots 30 and 34 provide a compensating field between the screen grid (G2) 16 and the first focusing (G3) electrode 18, which offsets any changes in the main lens, i.e., between the G3 and G4 electrodes, caused by focus voltage variations.

Figure 5:
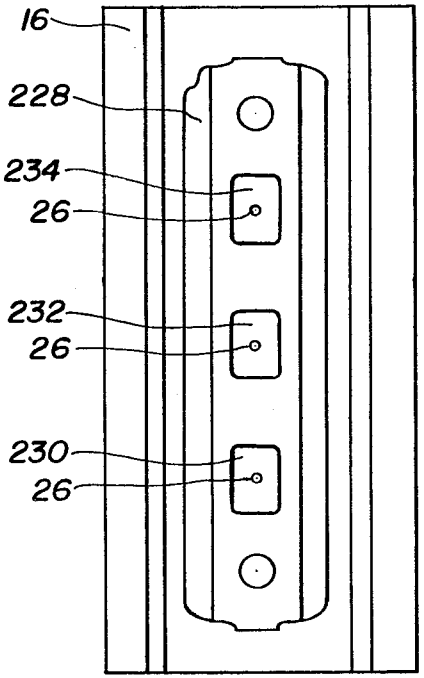
FIG. 5 is a plan view of a third embodiment of the present invention.
Figure 4:
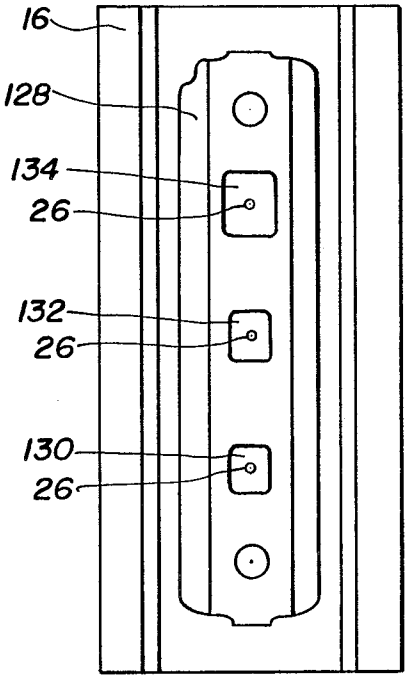
FIG. 4 is a plan view of a second embodiment of the present invention.

This type of correction is described in U.S. Pat. No. 4,523,123 issued to H-Y. Chen on June 11, 1985, which is incorporated by reference herein for the purpose of its disclosure. The amount of offset of slots 30 and 34 depends on the sizes of the slots in the screen grid plate portion 28, the longitudinal spacing between the top of the plate portion 28 and the lowest level of the top side of the screen grid, and the diameter of the screen grid apertures. In tubes where the focus voltage variation is not a significant problem, the outer slots 130 and 134 of the screen grid plate portion 128 can be symmetrically disposed about the outer apertures 26 in the screen grid 16, as shown in a second embodiment illustrated in FIG. 4. In this second embodiment, the dimensions and electron beam currents are otherwise identical to those described in the first preferred embodiment.

The present invention also is applicable to display tubes or other types of cathode-ray tubes including color picture tubes in which the cathode assemblies operates at substantially equal electron beam currents. In a third embodiment, the slots 230, 232 and 234 in the screen grid aperture plate 228 have equal dimensions in the horizontal and also in the vertical directions. For an electron beam current of 200 uA and a screen grid aperture diameter of 0.46 mm, the slots 230, 232 and 234 typically have a horizontal dimension of 2.54 mm and a vertical dimension of 1.78 mm.

Figure 6:
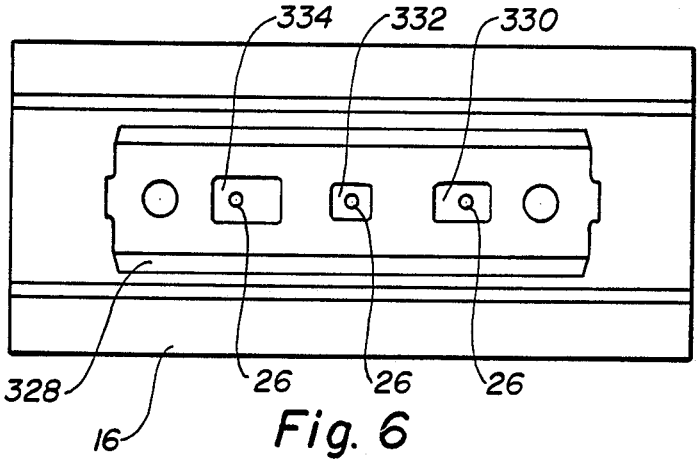
FIG. 6 is a plan view of a fourth embodiment of the present invention.

A fourth embodiment of the present invention is shown in FIG. 6. In this preferred embodiment, the cathode assemblies 12, shown in FIG. 1, produce electron beams having three different beam currents. The difference in beam currents is required because of different phosphor efficiencies and color temperatures of the particular phosphor materials. The details of the fourth embodiment are listed hereinafter in TABLE II. The outer slots 330 and 334 of the screen grid plate portion 328 are offset or asymmetric with respect to the outer screen grid apertures 26 so that the inline distance from the center of slot 330 to the center of slot 332 is 4.94 mm and the inline distance from the center of slot 332 to the center of slot 334 is 4.71 mm. The asymmetric slots 330 and 334 provide a compensating field between the screen grid (G2) 16 and the first focusing (G3) electrode 18 which compensates for any misconvergence caused by focus voltage variations that occurs in the main lens, i.e., between the G3 and G4 electrodes.

TABLE II

| | |
|---|---|
| Diameter of control grid apertures 24 | 0.46 mm |

TABLE II-continued

| | |
|---|---|
| Control grid to screen grid spacing | 0.20 mm |
| Diameter of screen grid apertures 26 | 0.46 mm |
| Thickness of the screen grid (at the apertures) | 0.38 mm |
| Center-to-center spacing between adjacent screen grid apertures | 5.08 mm |
| Screen grid plate portion 328 dimensions: | |
| Outer slot 330 (inline × transverse) | 2.39 mm × 1.89 mm |
| Center slot 332 (inline × transverse) | 2.02 mm × 1.72 mm |
| Outer slot 334 (inline × transverse) | 3.54 mm × 2.41 mm |
| Thickness at slots | 0.25 mm |
| Longitudinal spacing from top of screen grid plate portion 328 to the top of the lowest level of the screen grid 16 (at the apertures 26) | 0.56 mm |

The fourth embodiment described herein provides optimum tube performance at peak electron beam currents of approximately 225 uA, 185 uA and 350 uA for electron beams from the cathode assemblies 12 which address the blue-, green-, and red-emitting phosphor elements, respectively. The center slot 332, which is smaller than the outer slots 330 and 334, is associated with the screen grid aperture 26 through which the electron beam having the lowest peak electron beam current (185 uA) passes. The outer slot 334, which is larger than the other outer slot 330, is associated with the screen grid aperture 26 through which the electron beam having the highest peak electron beam current (350 uA) passes. The other outer slot 330, is of intermediate size and is associated with the screen grid aperture 26 through which the electron beam having a peak electron beam current of 225 uA passes. The screen grid plate portion 328 is attached to the intermediate level, or the second plane, of the screen grid 16 so that the slots 330, 332 and 334 lie in a second plane and are longitudinally spaced from the apertures 26 which lie in the first plane of the screen grid 16.

The above-described embodiments are not meant to be limiting; and different types of electron guns, as well as various combinations of electron beam currents, screen grid thickness, aperture diameter, plate portion thickness, slot dimensions, and longitudinal spacings between the top of the plate portion and the lowest level on the top side of the screen grid, are within the scope of this invention.

What is claimed is:

1. In an inline electron gun for use in a high resolution color cathode-ray tube comprising a plurality of inline cathode assemblies for producing a plurality of inline electron beams, a control grid adjacent to said cathode assemblies, said control grid having a plurality of inline apertures aligned with said cathode assemblies, a main electron lens spaced from said control grid, and a screen grid disposed between said control grid and said main electron lens, said screen grid having a plurality of inline apertures, lying in a first plane, aligned with said control grid apertures, the improvement comprising a screen grid plate portion disposed on the side of said screen grid facing said main electron lens, said screen grid plate portion having a plurality of inline openings therethrough, said openings lying in a second plane parallel to said first plane, each of said openings being associated with a different one of said apertures in said screen grid and longitudinally spaced therefrom, and each of said openings having an inline dimension and a transverse dimension selected to independently control the horizontal and vertical sizes of the spot produced by each of said electron beams at a distance remote from said electron gun, so as to maximize resolution and to minimize moire patterns and character graininess.

2. An inline electron gun for use in a high resolution color display tube, comprising three inline cathode assemblies for producing three inline electron beams, at least two of said electron beams operating at different electron beam currents, a control grid adjacent to said cathode assemblies, said control grid having three inline apertures aligned with said cathode assemblies, a main electron lens spaced from said control grid, said main electron lens including a first focusing electrode having three inline apertures directed towards said control grid and three inline apertures directed away from said control grid, and a second focusing electrode adjacent to and spaced from said first focusing electrode, said second focusing electrode including three inline apertures facing said first focusing electrode, a screen grid disposed between said control grid and said first focusing electrode, said screen grid having three inline apertures, lying in a first plane, aligned with said control grid apertures, and a screen grid plate portion disposed on the side of said screen grid facing said first focusing electrode, said screen grid plate portion having three inline openings therethrough, said openings comprising a center opening and two outer openings, lying in a second plane parallel to said first plane, each of said openings being associated with a different one of said apertures in said screen grid and longitudinally spaced therefrom, and each of said openings having an inline dimension and a transverse dimension, said dimensions being adjusted to control the horizontal and vertical sizes of the spot produced by each of said electron beams at a distance remote from said electron gun, so as to maximize resolution and to minimize moire and character graininess.

3. The inline electron gun as described in claim 2, wherein each of said three electron beams operates at a different electron beam current.

4. The inline electron gun as described in claim 3, wherein said openings in said screen grid plate portion are different in size from one another.

5. The inline electron gun as described in claim 4, wherein said openings in said screen grid plate portion are substantially rectangular.

6. The inline electron gun as described in claim 5, wherein said center opening in said screen grid plate portion is smaller in inline and transverse dimensions than the two outer openings, and operates on the one of said electron beams having the lowest electron beam current.

7. The inline electron gun as described in claim 6, wherein the center opening of said screen grid plate portion is located symmetrically about the center aperture in said screen grid, and the outer openings in said screen grid plate portion are asymmetric with respect to the outer apertures in said screen grid, each of said outer openings being displaced toward said center opening.

8. The inline electron gun as described in claim 7, wherein one of the outer openings in said screen grid plate portion is the larger outer opening and is displaced a greater distance toward the center opening than the other outer opening in said screen grid plate portion.

9. The inline electron gun as described in claim 8, wherein the larger outer opening in said screen grid plate portion operates on the electron beam having the highest electron beam current.

10. The inline electron gun as described in claim 2, wherein two of said openings in said screen grid plate portion are substantially identical in size, and the third of said openings in said screen grid plate portion is larger in inline and transverse dimensions than said other two openings.

11. The inline electron gun as described in claim 10 wherein said openings in said plate portion are located symmetrically about each of the associated apertures in the screen grid.

12. An inline electron gun for use in a high resolution color display tube, comprising three inline cathode assemblies for producing three inline electron beams which converge to a spot at a distance from said electron gun, two of said electron beams having a peak electron beam current of approximately 200 microamperes, and the third electron beam having a peak electron beam current of approximately 380 microamperes, a control grid, a screen grid and a main electron lens arranged successively in the order named for focusing said electron beams, said control grid being adjacent to said cathode assemblies and having three inline apertures aligned with said cathode assemblies, said screen grid being disposed between said control grid and said main electron lens, said screen grid having three levels with three inline apertures formed in the lowest of the three levels, said apertures being aligned with said control grid apertures, and a screen grid plate portion attached to the intermediate level of said screen grid on the side thereof facing said main electron lens, said screen grid plate portion having three inline substantially rectangular slots therethrough, each of said slots being associated with a different one of said screen grid apertures and longitudinally spaced therefrom, the two slots associated with the screen grid apertures through which the electron beams having an electron beam current of approximately 200 microamperes pass having an inline dimension and a transverse dimension smaller than those of said slot associated with the screen grid aperture through which the electron beam having an electron beam current of approximately 380 microamperes passes, and each of said slots acting on the electron beam passing therethrough to independently control the horizontal and vertical sizes of the spot produced by each of said electron beams at a distance from said electron gun, so as to maximize resolution and to minimize moire and character graininess.

13. The inline electron gun as described in claim 12, wherein the center slot of said plate portion is located symmetrically about the center aperture in said screen grid, and the outer slots in said plate portion are asymmetric in the inline dimension with respect to the outer apertures in said screen grid, each of said outer slots being displaced toward said center slot.

14. The inline electron gun described in claim 13, wherein the larger outer slot is displaced a greater distance toward the center slot than the other outer slot.

15. The inline electron gun as described in claim 12, wherein said slots in said plate portion are located symmetrically about each of the respective screen grid apertures.

16. An inline electron gun for use in a high resolution color display tube, comprising three inline cathode assemblies for producing three inline electron beams which converge to a spot at a distance from said electron gun, each of said electron beams having an electron beam current associated therewith, a control grid, a screen grid and a main electron lens arranged in the order named for focusing said electron beams, said control grid being adjacent to said cathode assemblies and having three inline apertures aligned with said cathode assemblies, said screen grid being disposed between said control grid and said main electron lens, said screen grid having three longitudinally spaced parallel planes with three inline apertures formed in the first plane, said apertures being aligned with said control grid apertures, and a screen grid plate portion attached to the second plane of said screen grid on the side thereof facing said main electron lens, said screen grid plate portion having three inline substantially rectangular slots therethrough, said slots comprising a center slot and two outer slots, the center slot being associated with the screen grid aperture through which the electron beam having the lowest peak electron beam current passes, said center slot having an inline dimension and a transverse dimension smaller than the dimensions of the outer slots, each of said slots acting on the electron beam passing therethrough to independently control the horizontal and vertical sizes of the spot produced by each of said electron beams at a distance from said electron gun, so as to maximize resolution and to minimize moire and character graininess.

17. The inline electron gun as described in claim 16, wherein one of the outer slots in said screen grid plate portion has an inline and a transverse dimension greater than the dimensions of the other outer slot, the larger of the outer slot being associated with the electron beam having the highest peak electron beam current.

18. The inline electron gun as described in claim 17, wherein the outer slots in said screen grid plate portion are asymmetric in the inline dimension with respect to the outer apertures in said screen grid, each of said outer slots being displaced toward said center slot.

19. The inline electron gun as described in claim 18, wherein the larger outer slot is displaced a greater distance toward the center slot than the other outer slot.

* * * * *